US005357730A

United States Patent [19]

Pickeral

[11] Patent Number: 5,357,730

[45] Date of Patent: Oct. 25, 1994

[54] METAL STUD SPREADER

[76] Inventor: George R. Pickeral, 25 Jefferson Dr., White Plains, Md. 20695

[21] Appl. No.: 71,397

[22] Filed: Jun. 4, 1993

[51] Int. Cl.[5] ..... E04G 21/16

[52] U.S. Cl. ..... 52/749; 52/DIG. 1; 269/904

[58] Field of Search ..... 269/47, 904, 909, 910, 269/4, 48.1; 52/749, DIG. 1

[56] References Cited

U.S. PATENT DOCUMENTS 2,241,704 5/1941 Goldsmith .
3,154,304 10/1964 Crawford ..... 269/904
4,181,295 1/1980 Duffy .
4,387,887 6/1983 Gentry ..... 269/904
4,404,751 9/1983 Rieckenberg .
4,453,362 6/1984 Rodgers .
4,791,266 12/1988 Gérard .
5,157,813 10/1992 Carrol .

*Primary Examiner*—Carl D. Friedman
*Assistant Examiner*—Christopher Todd Kent
*Attorney, Agent, or Firm*—John K. Donaghy

[57] ABSTRACT

A metal stud spreader for the U-channel of metal studs comprising a handle portion; an intermediate body portion; head portion; and at least one boss on the head to be placed in the U-channel whereby the U-channel is prevented from inward collapse.

4 Claims, 1 Drawing Sheet

METAL STUD SPREADER

BACKGROUND OF THE INVENTION

1. Field of the Invention

This invention pertains to a tool for use with wall studs and patentability to a tool to spread metal studs during installation thereof.

2. Background of the Prior Art

The prior art shows clips or bracing struts for use with baseboard structures; and tools for use in installing boxes to wall studs.

Representative of these prior art devices are U.S. Pat. Nos. 2,241,204; 4,181,295; 4,404,751; 4,453,362; 4,791,266; and 5,157,813.

SUMMARY OF THE INVENTION

Metal wall studs are in the form of U-shaped channel members. The sides adjacent the U-channel receive support members which are secured by screws through holes drilled in the support members and the sides of the studs.

During drilling into the support members and sides of the studs, certain force is required to advance the drill bit through the sides and supports. Often, this force causes the sides to collapse or flex inwardly making it impossible to drill the holes.

Presently, workers use a variety of common tools to prevent this collapse or inward flexing. A pair of pliers is the most common. These are cumbersome to use and often damage the metal studs.

There is a need for a tool to maintain metal studs spread during the drilling of holes through the sides of the studs and support members and applying tapping screws thereto to hold the pieces together.

It is therefore one object of this invention to provide metal stud spreader which is simple and inexpensive to manufacture.

It is another object of this invention to provide a metal stud spreader whereby an installer may drill holes in the stud without the collapsing or inward flexing of the stud.

It is still another object of this invention to provide tool for use in installing metal studs in supporting metal tracks whereby the tool is positioned in the U-channel of the stud to maintain the stud spread during drilling of a tapping hole through the metal track and stud.

And another object of this invention is to provide a metal stud spreader tool which has a series of bosses on a head portion ranging in width from 1 ¼ inch to 6 ¼ inches to accommodate the various widths of the U-channels of metal studs.

These and other objects of the invention will become apparent to those skilled in the art to which the invention pertains from a reading of the following specification when taken with the annexed drawings.

DETAILED DESCRIPTION OF THE PREFERRED EMBODIMENT OF THE INVENTION

Figure 3:
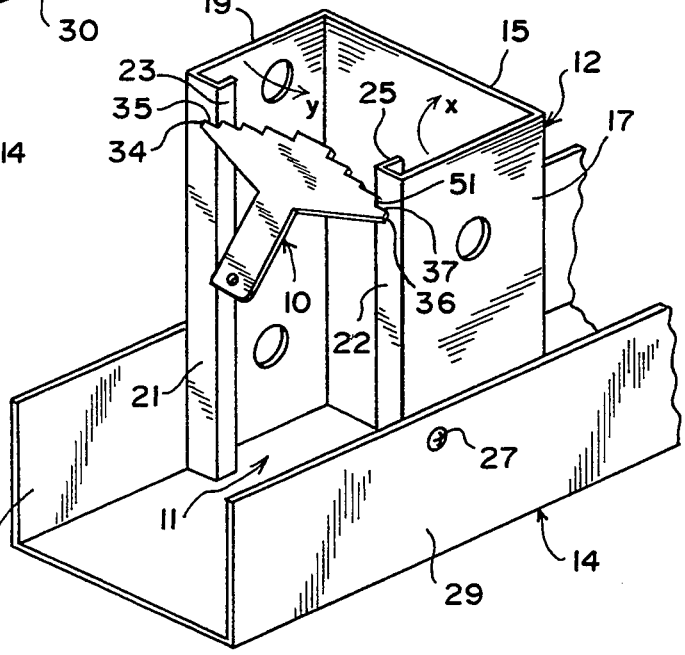
FIG. 3 is a perspective view of the metal stud, stud spreader and lower metal track which supports the stud.

Referring now in more detail to the drawings, FIG. 3 shows the environment in which the tool 10 is used in the installation of metal studs 12 to metal tracks 14 (one shown).

As can be seen, the metal stud 12 has a closed side wall 15 integral with end walls 17 and 19. The end wall 17 and 19 have end wall portions 21 and 22 parallel with and spaced from end wall 15. The end wall portions 21 and 22 have in-turned flat flanges 23 and 25 which are spaced from and parallel to ends 17 and 19. This construction provides a U-channel 11 between portions 23 and 25 and side 15.

It will be apparent that the metal stud 12 is a one piece construction and may be manufactured in various lengths and sizes whereby the U-channel will vary in size also.

The metal stud 12 is supported in top and bottom metal tracks 14 (bottom one shown). The tracks 14 are secured in place on the floor and on the ceiling. The studs 12 are then secured to the metal tracks 14 by tapping a screw 27 through the flange 29 of the track and end wall 17 and 19 of the stud.

To tap the screw 27, a hole is drilled through the flange 29 and 31 of the track and through the end walls 17 and 19 of the stud.

Drilling the hole requires that a certain force be applied to the drill in order for the drill bit to penetrate and pass through the two components 17, 29 and 31, 19. This force often causes the ends 17 and 19 to collapse or flex inwardly in the direction of the arrows X and Y whereby the drill bit does not penetrate. In order to prevent the inward collapsing or flexing, workers have used a pair of pliers to grip the portions 21, 23 or 22, 25 and apply an outward pressure against the inward pressure of the drill bit and thus prevent inward collapsing or flexing of components walls 17 and 19 thus ensuring of a drilled hole.

Often, however, the pliers may slip causing the drill bit to skid over wall 17 or 19 and injure the hand or finger of a worker. These injuries cause loss of work hours and injury compensation.

It became evident that a better tool was needed to ensure fast and safe drilling of tap holes in the flanges of metal tracks and through the end wall of metal studs.

The tool 10, FIGS. 1–4 shows such a device. The tool 10 has a handle portion 14 having a vinyl covering 16. Other abrasive or non-slip covering may be employed as by dipping the handle in such materials and allowing to dry. Rubber or plastic may be used also.

Adjacent the handle portion 14 is an intermediate body portion 18 which comprises outwardly sloping edges 30 and 32, terminating in end portions 34 and 36.

The outwardly sloping edges 30 and 32 and ends 34 and 36 have increasingly greater width than the handle portion 14. The width between ends 34 and 36 is approximately 3 times the width of the handle. This is necessary for providing greater strength in the tool head when used on the largest U-channel of the metal studs, to be more fully explained below.

Figure 4:
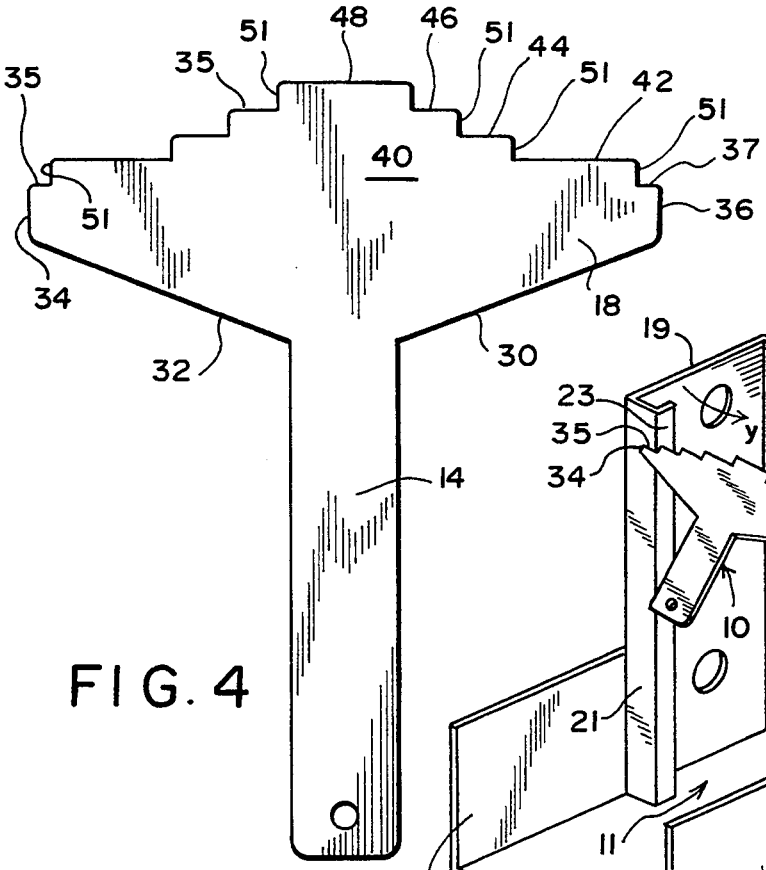
FIG. 4 is a perspective view of the stud spreader showing bosses of varying size thereon.

The tool 10 has a head portion 40, FIG. 4, comprising a series of stepped bosses 42, 44, 46 and 48.

Each boss 42–48 has horizontal step portions 35 and 37 and vertical flanges 51. Step portions 35 abut portions 21, 22 of the stud while vertical flange 51 abuts the inward flange portion 23, 25 of the stud.

When the tool 10 is placed in the U-channel 11, FIG. 3, the walls 17 and 19 are spread apart and a hole can be drilled through flange 29, 31 and walls 17 and 19 without inward collapsing or flexing of the wall 17 or 19.

The stepped bosses 42–48 correspond to the various sizes of U-channels 11 of various sized studs.

It will be seen that the stepped bosses 42–48 progressively become smaller in width by approximately 1" increments between bosses 44 and 48, and a two inch increment between bosses 42 and 44.

Figure 1:
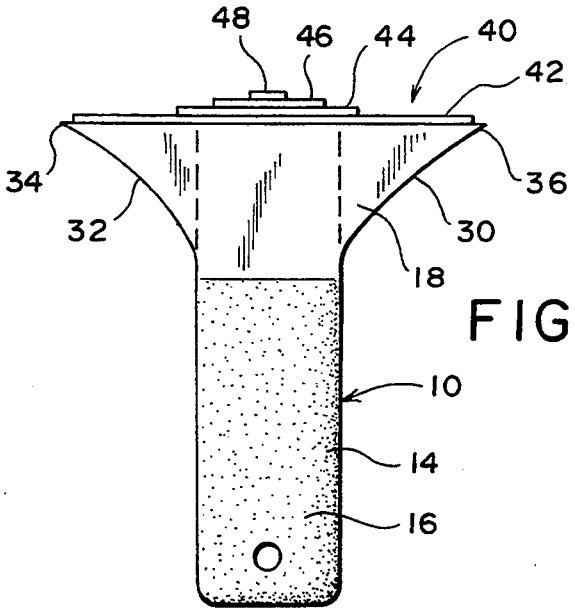
FIG. 1 is a plan view of the metal stud spreader showing a handle portion, an intermediate body portion and a head portion with bosses thereon.
Figure 2:
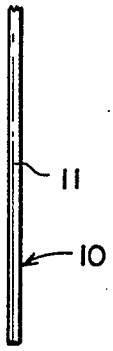
FIG. 2 is a side view of the handle portion and intermediate body portion showing a constant thickness.

It will be seen that the tool 10 is the same thickness, FIG. 2, throughout its length. This thickness is approximately ⅛".

The cooperation of the tool 10 with the metal stud 12 will be apparent from FIGS. 3 and 4. The tool is placed in the U-channel 11 with the appropriate portions 35, 51 abutting the stud walls 21, 23 and 22, 25 thus maintaining the U-channel 11 spread against the inward force of a drill bit. A hole is drilled in flange 29 or 31 of the track and wall 17 or 19 of the studs without inward collapsing or flexing of the U-channel.

The use of the tool of this invention saves time and personal injury to workers.

While the invention has been described with regard to a preferred embodiment thereof, it will be apparent to those skilled in the art to which the invention pertains that numerous changes in the design of the tool may be made without departing from the spirit or scope thereof.

What is claimed is:

1. A metal stud spreader for use with a metal stud, said metal stud spreader being substantially planar, said metal stud having a U-channel, comprising:

a handle portion;

an intermediate body portion;

a head portion; and said head portion having a series of bosses of increasing width to accommodate U-channels of different widths, and wherein said bosses are adapted.

2. A metal stud spreader according to claim 1, wherein:

said tool has a constant thickness and said bosses have one inch increment in widths.

3. A metal stud spreader according to claim 1, wherein said intermediate body portion has outwardly sloping edges terminating at end portions, the width of the tool at said end portions being in the order of three times the width of the handle portion.

4. A metal stud spreader according to claim 1, wherein:

said handle portion, intermediate body portion, head portion and bosses have the same thickness.

* * * * *